United States Patent [19]

Winkelmann et al.

[11] Patent Number: 4,695,043

[45] Date of Patent: Sep. 22, 1987

[54] GAS SCAVENGING APPARATUS FOR METALLURGICAL VESSELS

[75] Inventors: Manfred Winkelmann, Krefeld; Hans Rothfuss, Wiesbaden; Udo Muschner, Krefeld; Karl H. Schmitt, Meerbusch, all of Fed. Rep. of Germany

[73] Assignee: Didier-Werke AG, Wiesbaden, Fed. Rep. of Germany

[21] Appl. No.: 923,635

[22] Filed: Oct. 27, 1986

[30] Foreign Application Priority Data

Dec. 4, 1985 [DE] Fed. Rep. of Germany ..... 3542781

[51] Int. Cl.[4] ..... C21B 7/16

[52] U.S. Cl. ..... 266/265; 266/218

[58] Field of Search ..... 266/218, 265

[56] References Cited

U.S. PATENT DOCUMENTS

| | | | |
|---|---|---|---|
| 3,330,645 | 7/1967 | De Moustier | 266/265 |
| 3,971,548 | 7/1976 | Folgero | 266/265 |
| 4,331,471 | 5/1982 | Langenfeld | 266/265 |
| 4,539,043 | 9/1985 | Miyawaki | 266/265 |

*Primary Examiner*—Peter D. Rosenberg

*Attorney, Agent, or Firm*—Wenderoth, Lind & Ponack

[57] ABSTRACT

A gas scavenging apparatus for a metallurgical vessel containing molten metal includes a frusto-conical refractory inner scavenging block inserted in the refractory lining of the vessel and having a smaller end surface facing the molten metal and a larger base end directed away from the molten metal. A frusto-conical refractory outer scavenging block is embedded within a mounting brick positioned outwardly of the inner scavenging block. The outer scavenging block has a smaller end surface smaller than and facing the larger base end of the inner scavenging block and a larger base end directed away from the inner scavenging block. The larger base end of the inner scavenging block has an annular end surface extending generally radially outwardly away from the smaller end surface of the outer scavenging block and resting on the mounting brick. Scavenging gas is passed through the outer scavenging block and then through the inner scavenging block to the molten metal. The inner scavenging block does not load the outer scavenging block. The inner scavenging block may be replaced when necessary due to erosion by the molten metal, but the outer scavenging block does not require replacement.

15 Claims, 2 Drawing Figures

GAS SCAVENGING APPARATUS FOR METALLURGICAL VESSELS

BACKGROUND OF THE INVENTION

The present invention relates to a gas rinsing or scavenging apparatus for use in a metallurgical vessel containing molten metal, particularly an induction furnace, the apparatus being of the type including a frusto-conical refractory inner scavenging cone or block embedded in and extending through the refractory lining of the metallurgical vessel, the inner scavenging block having a smaller end surface facing the molten metal within the vessel and a larger base end directed away from the molten metal, whereby a scavenging gas to be supplied to the molten metal is passed through the inner scavenging block from the outer larger base end to the inner smaller end surface.

An apparatus of this type is described in the journal "Giesserei 72", 1985, No. 6, pages 133–136. In this apparatus the scavenging block rests on coarse tamping clay or a stamping mass. During operation the scavenging block becomes eroded and must be replaced, and when this is necessary the tamping clay also must be replaced. This is a complicated and time consuming operation.

West German DE-OS 32 40 097 discloses an arrangement wherein the scavenging block is provided with an insert of a filler material having a melting point below the temperature of the molten metal within the vessel. When the scavenging block becomes eroded to a point such that the molten metal within the vessel progresses to the filler material insert, such insert melts, thereby forming a seal which prevents the molten metal from the vessel from breaking through the scavenging block. A disadvantage of this arrangement however is that once this occurs, then it no longer is possible to supply the rinsing or scavenging gas through the scavenging block to the molten metal within the vessel.

SUMMARY OF THE INVENTION

With the above discussion in mind, it is an object of the present invention to provide a gas scavenging apparatus for use in a metallurgical vessel containing molten metal, particularly an induction furnace, whereby it is possible to overcome the above and other prior art disadvantages.

It is a more particular object of the present invention to provide such an apparatus whereby it is possible to prevent molten metal breakthrough while continuing a gas scavenging operation, and whereby once it becomes necessary to replace the inner scavenging block, this may be achieved relatively easily without replacement of the remainder of the apparatus.

These objects are achieved in accordance with the present invention by the provision of a frusto-conical refractory outer scavenging block extending through a mounting brick and positioned outwardly of the inner scavenging block. The outer scavenging block has a smaller end surface smaller than and facing the larger base end of the inner scavenging block and a larger base end directed away from the inner scavenging block. The larger base end of the inner scavenging block has an annular end surface extending radially outwardly away from the smaller end surface of the outer scavenging block and resting on the mounting block. Thus, scavenging gas is passed through the outer scavenging block and then through the inner scavenging block to be supplied to the molten metal.

In accordance with this arrangement of the present invention, the upper, inner scavenging block easily can be replaced when necessary. Furthermore, the inner scavenging block is not supported by and does not load the outer scavenging block. Furthermore, efficient rinsing or scavenging is achieved since the inner scavenging block does not taper directly inwardly from the dimension of the smaller inner end of the outer scavenging block. Rather, the inner scavenging block, at the area thereof adjacent the inner smaller end of the outer scavenging block, has an enlarged cross section which then tapers inwardly. This arrangement provides for an efficient scavenging gas supply without the need for overly large parts.

The apparatus of the present invention can be used, for example, in the aluminum industry, in the manufacture of gray cast iron, in steel work ladles, in transport vessels for pig iron, in continuous casting installations, and in converters. Those skilled in the art would appreciate other potential uses for the apparatus of the present invention.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
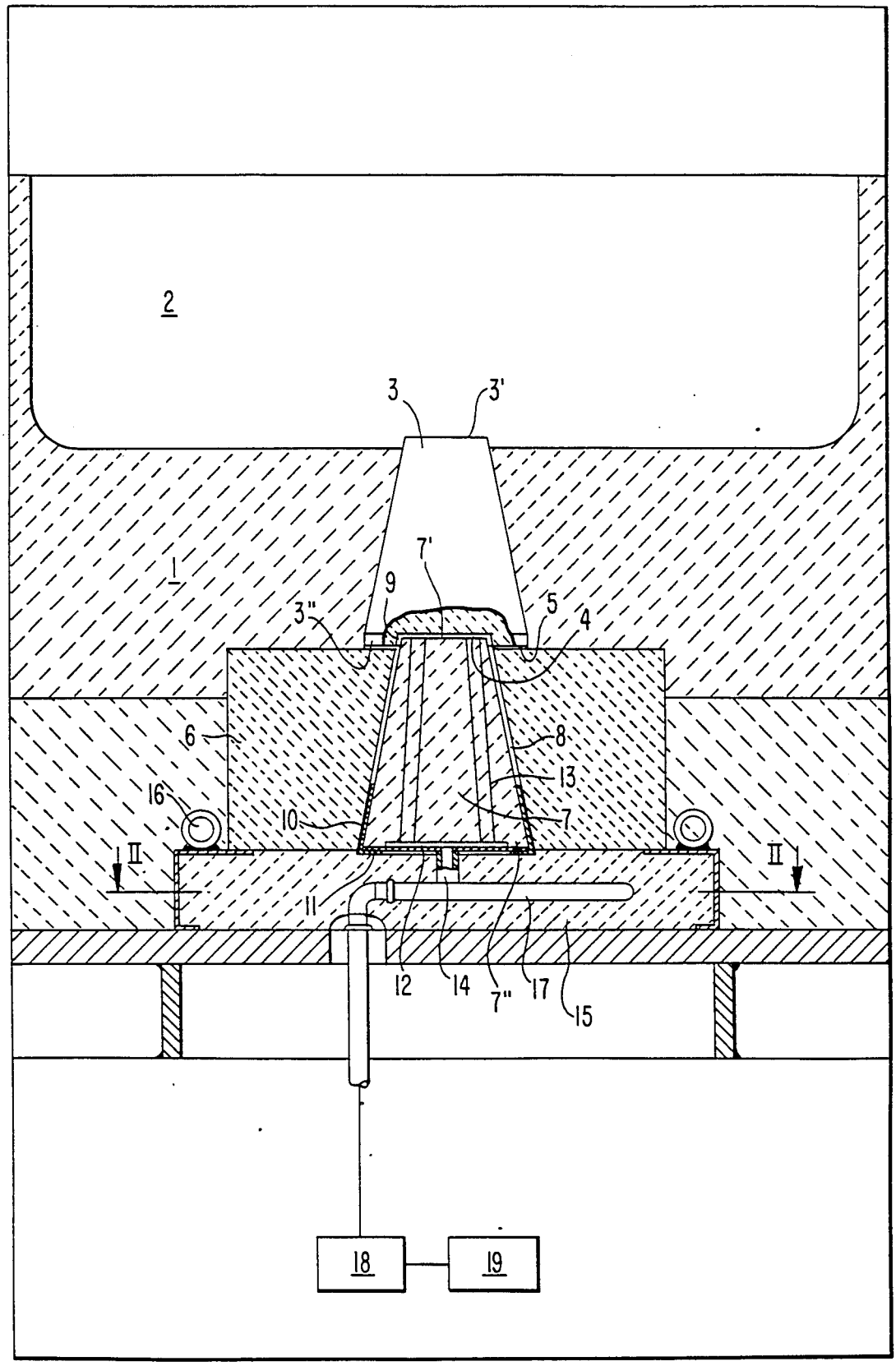
FIG. 1 is a somewhat schematic cross sectional view through the bottom of a metallurgical vessel equipped with the gas scavenging apparatus of the present invention.

In FIG. 1 is shown a portion of the bottom of a metallurgical vessel 2 having a refractory lining 1. A frusto-conical refractory inner rinsing or scavenging block 3 is embedded in and extends through refractory lining 1 and is adapted to have passed therethrough a scavenging gas to be supplied to molten metal contained within vessel 2. Inner scavenging block 3 is imperforate has a smaller end surface 3' projecting into vessel 2 and facing molten metal therein and a larger base end 3" directed away from the molten metal. Positioned outwardly, i.e. below, inner scavenging block 3 is a frusto-conical refractory outer scavenging block 7 mounted within a mounting brick 6 positioned outwardly, i.e. below, inner scavenging block 3. Outer scavenging block 7 has a smaller end surface 7' smaller than larger base end 3" of inner scavenging block 3. Smaller end surface 7' faces the larger base end 3" of inner scavenging block 3. Outer scavenging block 7 also has a larger base end 7" directed away from inner scavenging block 3. The larger base end 3" of inner scavenging block 3 has an annular end surface 5 extending outwardly, i.e. generally radially, away from the smaller end of outer scavenging block 7, and annular surface 5 rests on and is supported by mounting brick 6. Thus, inner scavenging block 3 does not rest on and load the outer scavenging block 7. Outer scavenging block 7 is retained within mounting block 6 by means of a gas-tight mortar 8, for example a refractory mortar. A pressure distribution chamber 9 is defined between the smaller end surface 7' of outer scavenging block 7 and the larger base end 3"

of inner scavenging block 3, and chamber 9 is defined by a recess 4 formed centrally in larger base end 3'' of inner scavenging block 3, with smaller end surface 7' of outer scavenging block 7 extending into recess 4 but spaced from contact with inner scavenging block 3. By such arrangement, it is possible to ensure that scavenging gas which is passed through outer scavenging block 7 is supplied uniformly to inner scavenging block 3.

The lower end of outer scavenging block 7 is surrounded by a metal jacket 10 which supports a bottom plate 11, above which is defined a gas distribution chamber 12 formed by a recess defined centrally in the larger base end 7'' of outer scavenging block 7. The refractory material of inner scavenging cone 3 is porous to the scavenging gas, in a manner which would be understood by one skilled in the art. In a preferred arrangement, outer scavenging block 7 has extending therethrough capillary tubes or passages 13 which extend between gas distribution chambers 12 and 9. In the illustrated arrangement, the smaller end surfaces 3', 7' of the inner and outer scavenging blocks 3, 7 are of the same size, but may be of different sizes. Further in the illustrated arrangement, the larger end bases 3'', 7'' of the inner and outer scavenging blocks 3, 7 are of the same size, but may be of different sizes.

Figure 2:
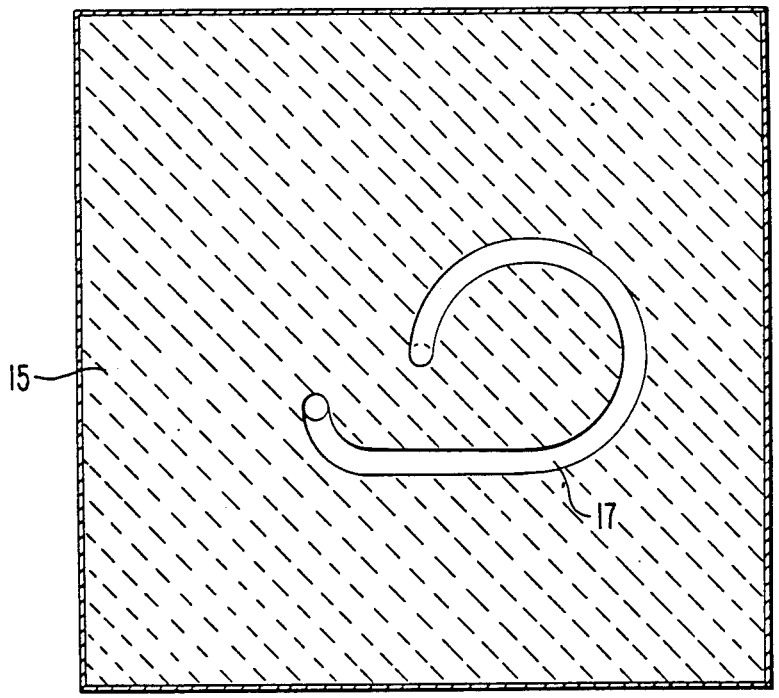
FIG. 2 is a partial sectional view taken along line II—II of FIG. 1.

Positioned outwardly, i.e. below, mounting brick 6 and outer scavenging block 7 is a supporting block 15 formed of a suitable refractory material and having a metal jacket. Extending through block 15 is a gas passage 17, for example having a configuration shown in FIG. 2, with a first end connected to a source 19 of scavenging gas and a second end connected to a gas inlet 14 opening into gas distribution chamber 12.

By the above arrangement of the present invention, scavenging gas is supplied to chamber 12 and is uniformly distributed therefrom through capillary passages 13 in outer scavenging block 7 and then into chamber 9 from which the scavenging gas is distributed uniformly into inner scavenging block 3. The scavenging gas then passes from inner, smaller end surface 3' into molten metal within vessel 2.

When the installation first is assembled, then a simple modular unit of supporting block 15, mounting brick 6 and outer scavenging block 7 are lifted and installed, for example by means of support eyelets 16. After completion of the vessel structure, such modular unit and the parts thereof substantially are not subjected to wear or erosion and essentially do not need to be replaced. However, during use of the vessel the refractory lining 1 and the inner scavenging block 3 become eroded and periodically require replacement. This may be achieved easily from the interior of the vessel without the need for disturbing or removal of elements 7, 6, 15. Additionally, during the initial formation of the installation, the modular unit may have fastened thereto, for example by means of a gas-tight mortar layer between surface 5 and brick 6, an initially employed inner scavenging block 3. Such initial inner scavenging block 3 of course will require replacement during the life of the vessel. However, for all intents and purposes, outer scavenging block 7 never will be worn or eroded and will not require replacement.

Additionally, it is possible to connect means, for example a flow rate meter 18, between gas inlet 14 and scavenging gas source 19. Thereby, during operation of the apparatus, as inner scavenging block 3 becomes eroded, such erosiion can be detected by meter 18 as a function of a change in the flow of the scavenging gas.

Due to the above structure of the apparatus of the present invention there is no necessity for providing a metal jacket around inner scavenging block 3. Thus, exclusively ceramic material is in contact with the molten metal within vessel 2, even after erosion of lining 1 and block 3. This feature is particularly advantageous when the apparatus is employed in an induction furnace, since there will be no danger of electrical sparkover.

Although the present invention has been described and illustrated with respect to preferred features, it is to be understood that various modifications and changes may be made to the specifically described and illustrated features, as would be understood by one skilled in the art, without departing from the scope of the present invention.

We claim:

1. In a gas scavenging apparatus for use in a metallurgical vessel containing molten metal, said apparatus including a frusto-conical refractory inner scavenging block to be inserted in a refractory lining of the vessel and to have passed therethrough a scavenging gas to be supplied to the molten metal in the vessel, said inner scavenging block having a smaller end surface facing the molten metal and a larger base end directed away from the molten metal, the improvement comprising:

a mounting brick positioned outwardly of said inner scavenging block;

a frusto-conical refractory outer scavenging block extending through said mounting brick, said outer scavenging block having a smaller end surface smaller than and facing said larger base end of said inner scavenging block and a larger base end directed away from said inner scavenging block;

said larger base end of said inner scavenging block having an annular end surface extending outwardly away from said smaller end surface of said outer scavenging block and resting on said mounting brick; and said inner scavenging block being formed of a refractory material porous to the scavenging gas, and said outer scavenging block having extending therethrough capillary passages;

whereby scavenging gas may be passed through said outer scavenging block and then through said inner scavenging block to be supplied to the molten metal.

2. The improvement claimed in claim 1, further comprising a pressure distribution chamber defined between said smaller end surface of said outer scavenging block and said larger base end of said inner scavenging block, thereby enabling scavenging gas which has passed through said outer scavenging block to be supplied uniformly to said inner scavenging block.

3. The improvement claimed in claim 2, wherein said chamber is defined by a recess formed centrally in said larger base end of said inner scavenging block, said smaller end surface of said outer scavenging block extending into said recess, and said annular surface extending outwardly away from said recess.

4. The improvement claimed in claim 1, wherein said smaller end surfaces of said inner and outer scavenging blocks are of the same size.

5. The improvement claimed in claim 1, wherein said smaller end surfaces of said inner and outer scavenging blocks are of different sizes.

6. The improvement claimed in claim 1, wherein said larger end bases of said inner and outer scavenging blocks are of the same size.

7. The improvement claimed in claim 1, wherein said larger end bases of said inner and outer scavenging blocks are of different sizes.

8. The improvement claimed in claim 1, wherein said outer scavenging block is retained within said mounting brick by means of a gas-tight refractory mortar.

9. The improvement claimed in claim 1, further comprising a supporting member positioned outwardly of and supporting said mounting brick and said outer scavenging block, and means for supplying scavenging gas through said supporting member to said larger base end of said outer scavenging block.

10. The improvement claimed in claim 9, wherein said supporting member is a refractory block having a metal jacket.

11. The improvement claimed in claim 9, wherein said supplying means comprises a gas passage extending through said supporting member and having a first end to be connected to the scavenging gas source and a second end opening at said larger base end of said outer scavenging block.

12. The improvement claimed in claim 11, further comprising means connected to said gas passage for detecting erosion of said inner scavenging block as a function of a change in the flow of scavenging gas through said gas passage.

13. The improvement claimed in claim 9, further comprising a pressure distribution chamber defined between said supporting member and said larger base end of said outer scavenging block, thereby enabling scavenging gas which has passed through said supporting member to be supplied uniformly to said outer scavenging block.

14. The improvement claimed in claim 13, wherein said chamber is defined by a recess formed in said larger base end of said outer scavenging block.

15. The improvement claimed in claim 1, wherein said inner scavenging block is imperforate.

* * * * *